US011679470B1

(12) United States Patent
Yi

(10) Patent No.: US 11,679,470 B1
(45) Date of Patent: Jun. 20, 2023

(54) GRINDING MACHINE FOR TUNGSTEN ELECTRODE

(71) Applicant: SHENZHEN SANJING TECHNOLOGY CO., LTD., Guangdong (CN)

(72) Inventor: Wen Yi, Guangdong (CN)

(73) Assignee: SHENZHEN SANJING TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/939,002

(22) Filed: Sep. 7, 2022

(30) Foreign Application Priority Data

Jul. 15, 2022 (CN) ..... 202210832547.2

(51) Int. Cl.

| | |
|---|---|
| ***B24B 41/06*** | (2012.01) |
| ***B24B 19/16*** | (2006.01) |
| ***B24B 55/10*** | (2006.01) |
| ***B24B 47/12*** | (2006.01) |
| ***B24B 41/00*** | (2006.01) |

(52) U.S. Cl.
CPC ..... *B24B 41/06* (2013.01); *B24B 19/16* (2013.01); *B24B 41/002* (2013.01); *B24B 47/12* (2013.01); *B24B 55/10* (2013.01)

(58) Field of Classification Search
CPC ..... B24B 19/16; B24B 23/005; B24B 41/06; B24B 55/06; B23K 11/3063
USPC ..... 451/453, 456, 279, 282, 365, 387, 405
See application file for complete search history.

(56) References Cited

U.S. PATENT DOCUMENTS 4,100,702 A * 7/1978 Zapart ..... B24B 41/06 451/920
6,106,372 A * 8/2000 Clark ..... B24B 19/16 451/48

(Continued)

FOREIGN PATENT DOCUMENTS

KR 20130123228 A * 11/2013 ..... B24B 23/02
KR 20160004532 U * 12/2016 ..... B24B 49/00
WO WO-2020262759 A1 * 12/2020 ..... B24B 19/16

OTHER PUBLICATIONS

치-웬 린, , KR-20130123228-U machine translation, Dec. 30, 2016 (Year: 2016).*

(Continued)

*Primary Examiner* — Monica S Carter
*Assistant Examiner* — Marcel T Dion
(74) *Attorney, Agent, or Firm* — Cooper Legal Group, LLC

(57) ABSTRACT

The present application relates to a grinding machine for tungsten electrode, which includes a driving device and a grinding device arranged on a driving end of the driving device. The grinding device includes a mounting assembly and an adjusting assembly. The mounting assembly is mounted on the driving device, the driving end of the driving device passes through the mounting assembly, the mounting assembly is provided with a grinding chamber, a grinding plate is provided at the driving end of the driving device, and the grinding plate is positioned in the grinding chamber. The adjusting assembly is rotatably connected to the mounting assembly, the adjusting assembly is provided with a clamping component, and the adjusting assembly is configured to adjust a grinding angle of the tungsten electrode on the grinding plate.

6 Claims, 7 Drawing Sheets

(56) References Cited

U.S. PATENT DOCUMENTS

| | | | | |
|---|---|---|---|---|
| 2003/0002945 | A1* | 1/2003 | Sunaga | B24B 19/16 409/131 |
| 2008/0108284 | A1* | 5/2008 | Tamm | B24B 19/16 451/282 |
| 2013/0288580 | A1* | 10/2013 | Tamm | B24B 19/16 451/363 |
| 2015/0360315 | A1* | 12/2015 | Kusano | B08B 15/04 15/347 |
| 2019/0381627 | A1* | 12/2019 | Hosseini | B24B 19/16 |
| 2020/0070298 | A1* | 3/2020 | Bradley | B24B 19/16 |

OTHER PUBLICATIONS

Choi, WO-2020262759-A1 machine translation, Dec. 30, 2020 (Year: 2020).*

Kim, KR20130123228-A machine translation, Nov. 12, 2013 (Year: 2013).*

* cited by examiner

GRINDING MACHINE FOR TUNGSTEN ELECTRODE

CROSS-REFERENCE TO RELATED APPLICATION

This application claims the priority and benefit of Chinese patent application serial no. 202210832547.2, filed on Jul. 15, 2022. The entirety of Chinese patent application serial no. 202210832547.2 is hereby incorporated by reference herein and made a part of this specification.

TECHNICAL FIELD

The present application relates to a field of grinding technology and in particular a grinding machine for tungsten electrode.

BACKGROUND ART

With the development and the expanding application of the tungsten electrode inert gas welding, the research on the tungsten electrode is gradually increased. The tungsten electrode is a cylindrical tungsten pin made by adding rare earth oxides in tungsten, which has the advantages of high melting point, good corrosion resistance, high density, excellent thermal and conductive performance. Before use, the end of the tungsten electrode close to the welding element needs to be grinded and sharpened to a taper shape with a sharp or flat end according to the using demand.

The sharp and taper end of the tungsten electrode plays an important role in the arc striking, arc stability and the welding quality of the argon tungsten arc welding. The angle of the sharp end determines the depth of arc intrusion into the welding element. The trace line on the outer surface of the sharp end caused by grinding needs to be longitudinal, which is consistent with the axis of the tungsten electrode and the current direction. Otherwise, the arc is easy to be unstable and it is easy to cause arc extinction.

At present, it is generally to use large equipment like the numeral control machine, grinding machine and wire cutting machine to process the tungsten electrode. Since the equipment is large and expensive, the processing cost is extremely high, so that it is only suitable for the batch production and is not suitable for the small batch tungsten electrode processing. During processing the tungsten electrode, the small equipment in the market is hard to control the grinding angle, so that the tungsten electrode has a bad coaxiality and the sharp end is easy to be eccentric, further to influence the using performance of the tungsten electrode, which is needed to be improved.

SUMMARY

In order to solve the problem that it is hard to accurately control the grinding angle of the tungsten electrode, the present application provides a grinding machine for tungsten electrode.

The grinding machine for tungsten electrode provided in the present application adopts the following technical solution.

A grinding machine for tungsten electrode includes a driving device and a grinding device arranged on a driving end of the driving device. The grinding device includes a mounting assembly and an adjusting assembly. The mounting assembly is mounted on the driving device, the driving end of the driving device passes through the mounting assembly, the mounting assembly is provided with a grinding chamber, a grinding plate is provided at the driving end of the driving device, and the grinding plate is positioned in the grinding chamber. The adjusting assembly is rotatably connected to the mounting assembly, the adjusting assembly is provided with a clamping component, and the adjusting assembly is configured to adjust a grinding angle with which a tungsten electrode is grinded by the grinding plate.

With the above technical solution, when grinding, the driving end of the driving device drives the grinding plate in the grinding chamber to rotate. Then the adjusting assembly is rotated according to the demand, so that the grinding angle of the tungsten electrode fixed on the clamping component can be adjusted to any degree, so as to accurately control the grinding angle of the tungsten electrode, which ensures the consistent grinding angle of the sharp end of the tungsten electrode, improves the grinding accuracy and ensures the using performance of the tungsten electrode.

In some embodiments, the mounting assembly includes a scale ring and a mounting base arranged on an outer wall of the scale ring, the scale ring and the mounting base are both provided with a through hole for the driving end of the driving device to pass through, and the mounting base is detachably connected to the driving device.

With the above technical solution, the driving end of the driving device is positioned in the scale ring through the through hole, and the grinding plate is mounted at the driving end. The driving device drives the grinding plate to rotate in the scale ring, then the tungsten electrode is adjusted by the adjusting assembly, which facilitates adjusting the grinding plate to position at any degree. Since the mounting base is detachable connected to the driving device, it is convenient to detach the grinding device from the driving device, so as to facilitate replacing grinding devices with different sizes and repairing the grinding machine for tungsten electrode.

In some embodiments, a diameter and an axial line of the scale ring are both positioned on the plane of the grinding plate, scale lines on the scale ring are positioned at a side of the scale ring away from the driving device, a zero-degree scale line is positioned on the plane where the grinding plate is located, and a ninety-degree scale line of is perpendicular to an axial line of the grinding plate.

With the above technical solution, the diameter and the axial line of the scale ring are both positioned on the plane of the grinding plate, so that the grinding plate is positioned in the center of the scale ring. The scale line of the null point is also positioned on the plane of the grinding plate and the scale line of the ninety-degree point is perpendicular to the axial line of the grinding plate, so as to accurately adjust the grinding angle of the tungsten electrode, which improves the using performance of the tungsten electrode.

In some embodiments, the adjusting assembly includes an adjusting ring, the adjusting ring is rotatably connected to the scale ring, an annular protrusion embedded is formed on an end face of the adjusting ring facing to the scale ring the annular protrusion is able to be embedded in the scale ring, a positioning groove is provided on the annular protrusion around an outer wall thereof, positioning holes are provided on an outer wall of the scale ring at positions corresponding to the positioning groove, and a the scale ring is fixed with the adjusting ring at the positioning holes and a the positioning groove by positioning components.

With the above technical solution, the positioning hole is arranged to be aligned with the positioning groove. The positioning component is embedded in the positioning groove through the positioning hole, so that the adjusting ring is hard to separate from the scale ring. In addition, by setting the embedding degree of the positioning component, the rotating state and the fixing state of the adjusting ring are controlled, which facilitates adjusting the grinding angle of the tungsten electrode and improving the stability of the adjusting ring during grinding, so as to improve the using performance of the tungsten electrode.

In some embodiments, one or more mounting holes are provided on an outer wall of the adjusting ring, the clamping component is mounted in the mounting hole, a positioning line is scribe on the outer wall of the adjusting ring close to each of the one or more mounting holes, a length direction of the positioning line is parallel to a length direction of the scale line on the scale ring, and an extension line of the positioning line intersects an axial line of the mounting hole.

With the above technical solution, the positioning line perpendicularly intersects the axial line of the mounting hole, the positioning line is aligned with the scale, which facilitates observing the grinding angle of the tungsten electrode, and is convenient to operate.

In some embodiments, the axial line of the mounting hole perpendicularly intersects the axial line of the adjusting ring, and the mounting holes are distributed at an interval on the adjusting ring and are tilted along an axial direction of the adjusting ring.

With the above technical solution, the axial line of the mounting hole perpendicularly intersects the axial line of the adjusting ring, so that the length direction of the tungsten electrode during grinding is perpendicular to the axial of the scale ring, which improves the coaxiality and grinding accuracy. The mounting holes are obliquely distributed around the axial of the adjusting ring, which can take fully use of the grinding area of the grinding plate. The tungsten electrode can be mounted in the mounting holes with different tilting degrees, which reduces the wear and tear of the grinding plate, takes fully use of the grinding plate, and reduces the replacement cycle, so as to reduce the cost. In addition, when grinding multiple tungsten electrodes, the oblique distribution brings less interaction between the tungsten electrodes during grinding, which improves the grinding efficiency.

In some embodiments, the clamping component has a clamping hole for a tungsten electrode to pass through, the grinding chamber is communicated with an external space through the clamping hole, and an inner diameter of the clamping hole is adjustable.

With the above technical solution, a clamping hole with adjustable inner diameter is provided on the clamping component, so that the clamping component can hold tungsten electrodes with different sizes, and the tungsten electrode can be rotated and grinded by hand or tool.

In some embodiments, the adjusting assembly further includes a magnifier, and the magnifier is arranged at an opening of the adjusting ring away from the scale ring.

With the above technical solution, with the magnifier, the grinding situation of the tungsten electrode can be clearly observed, and the grinding angle and coaxiality of the tungsten electrode can be accurately controlled, which makes the sharp end of the tungsten electrode not easy to be eccentric, so as to improve the using performance of the tungsten electrode.

In some embodiments, the adjusting ring is provided with a sealing ring at a side of the adjusting ring where the magnifier is located, a dust sucking pipe is provided at an opening of the scale ring away from the adjusting ring, and the dust sucking pipe is used for communicating with an external dust sucking equipment.

With the above technical solution, the magnifier can be sealed by the sealing ring, the dust sucking pipe can match with the external dust sucking equipment for sucking the dust generated in the grinding process, which can prevent the spread of harmful dust from being inhaled by the human body and affecting health.

In some embodiments, a mounting portion and a matching portion are provided on two ends of the dust sucking pipe respectively, the mounting portion is detachably connected to the scale ring, an annular flange is provided on an inner wall of the matching portion, an inner diameter of the annular flange gradually increases along a direction away from the mounting portion to form a first matching area, an inner diameter of the matching portion gradually increases along a direction away from the mounting portion to form a second matching area, and an outer diameter of the matching portion gradually decreases along the direction away from the mounting portion to form a third matching area.

With the above technical solution, the mounting portion facilitates the connection between the duck sucking pipe and the scale ring, the first matching area is used for connecting to the external household dust sucking equipment, the second matching area is used for connecting to the external commercial dust sucking equipment, and the third matching area is used for connecting to the dust sucking equipment with larger outer diameter. The matching portion makes the grinding machine for tungsten electrode suitable for dust sucking equipment with different diameters, so as to increase the application range of the grinding machine for tungsten electrode.

In conclusion, the present application includes at least one of the following beneficial effect:

1. the driving end of the driving device drives the grinding plate in the grinding chamber to rotate, the adjusting assembly is rotated, so that the grinding angle of the tungsten electrode fixed on the clamping component can be adjusted to any degree, further to control the grinding angle of the tungsten electrode, which ensures the consistent grinding angle of the sharp end of the tungsten electrode, improves the grinding accuracy and ensures the using performance of the tungsten electrode;
2. the axial line of the mounting hole perpendicularly intersects the axial line of the scale ring, and the axial line of the scale ring is coincided with the diameter of the grinding plate, so that the trace generated by grinding the surface of the sharp end of the tungsten electrode is consistent with the axial line of the tungsten electrode, which improves the stability of the arc;
3. with the magnifier, the grinding situation of the tungsten electrode can be clearly observed, and the grinding angle and coaxiality of the tungsten electrode can be accurately controlled, which makes the sharp end of the tungsten electrode not easy to be eccentric, so as to improve the using performance of the tungsten electrode;
4. the dust sucking pipe can match with the external dust sucking equipment for sucking the harmful dust in the grinding chamber, which prevents the spread of harmful dust from being inhaled by the human body and affecting health and enlarges the application range of the grinding machine for tungsten electrode.

DETAILED DESCRIPTION

The present application is further described in detail below in combination with FIGS. 1-7.

The embodiment in the present application provides a grinding machine for tungsten electrode.

Figure 1:
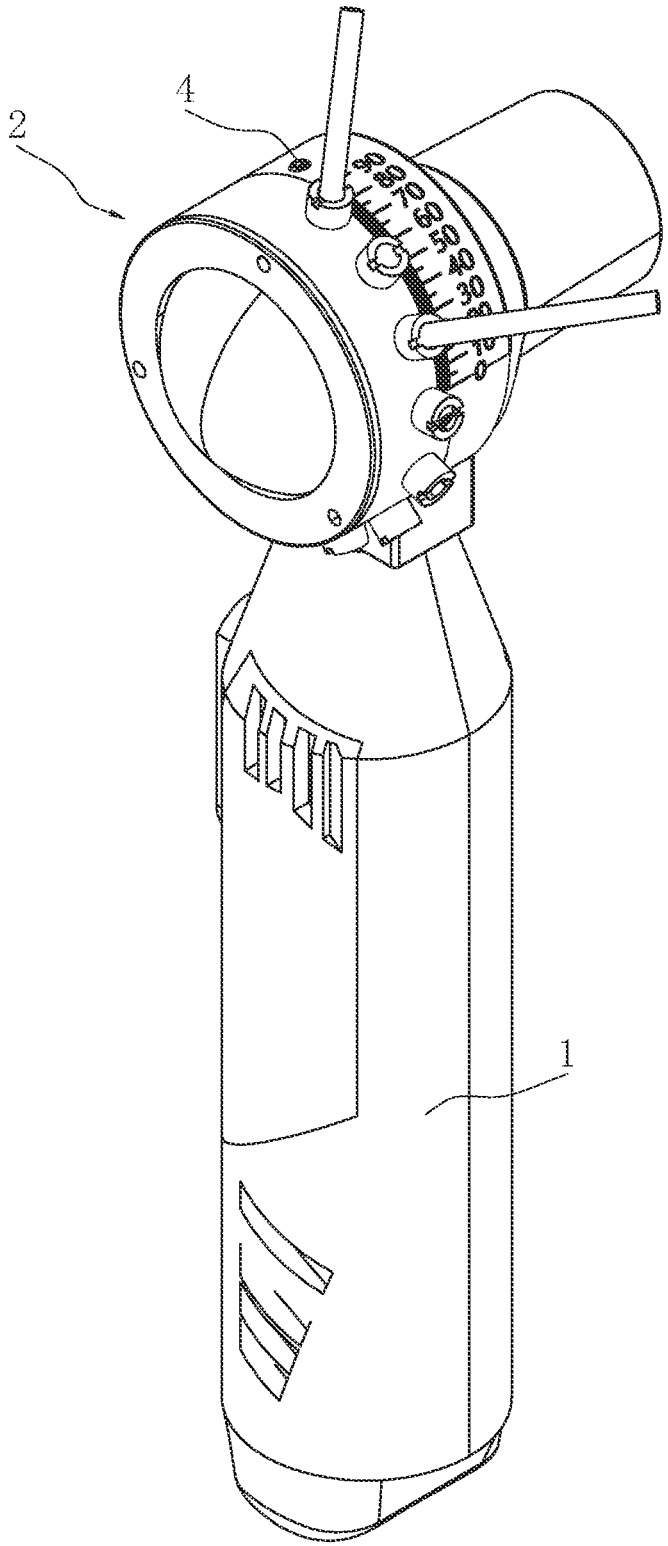
FIG. 1 is an overall structural schematic diagram according to an embodiment of the present application.
Figure 2:
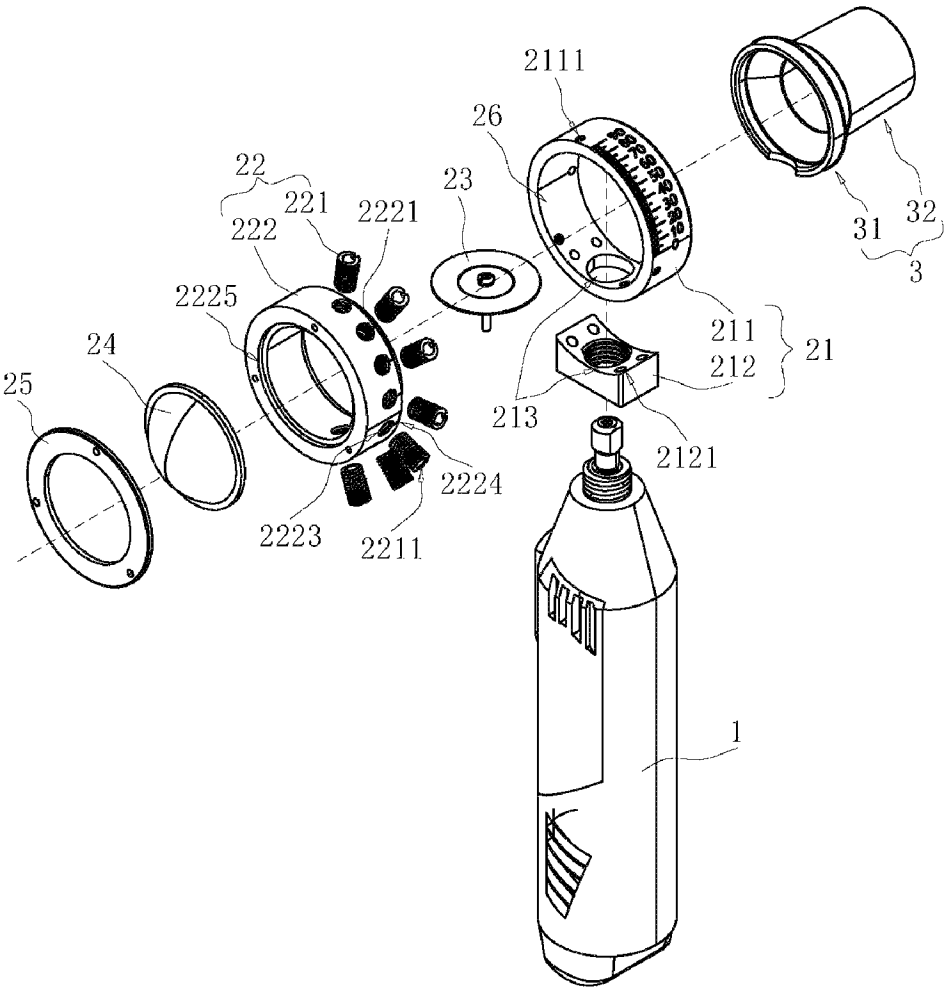
FIG. 2 is a structural explosion diagram according to an embodiment of the present application.

Referring to FIG. 1 and FIG. 2, the grinding machine for tungsten electrode includes a driving device 1 and a grinding device 2. The grinding device 2 is arranged on a driving end of the driving device 1. The grinding device 2 includes a mounting assembly 21 and an adjusting assembly 22. The adjusting assembly 22 can be rotatably connected to the mounting assembly 21. The mounting assembly 21 is mounted on the driving device 1. The mounting assembly 21 is provided with a grinding chamber 26. The driving end of the driving device 1 passes through the mounting assembly 21 and is positioned in the grinding chamber 26. A grinding plate 23 is mounted on the driving end of the driving device 1 through the grinding chamber 26. The driving device 1 drives the grinding plate 23 to rotate in the grinding chamber 26. A clamping component 221 is provided in the adjusting assembly 22. The clamping component 221 holds a tungsten electrode, so that a sharp end of the tungsten electrode abuts to the grinding plate 23. The grinding angle of the tungsten electrode on the grinding plate 23 can be adjusted by rotating the adjusting assembly 22, so that the grinding angle of the tungsten electrode can be adjusted to any degree according to the demand, which ensures the consistent grinding angle of the sharp end of the tungsten electrode, improves the grinding accuracy and ensures the using performance of the tungsten electrode.

Figure 3:
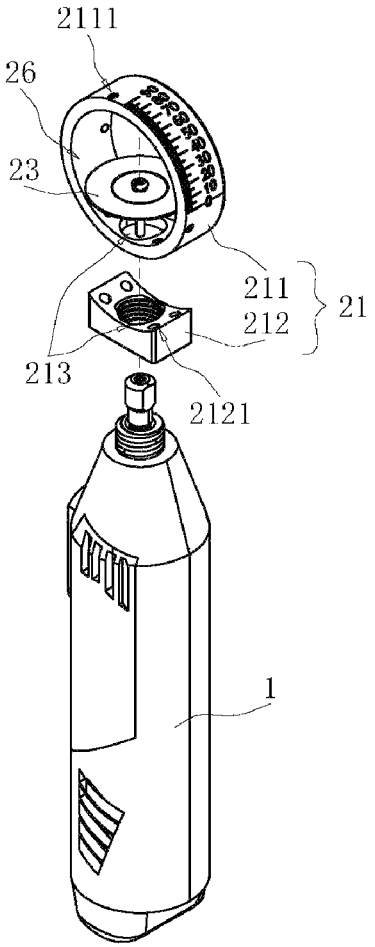
FIG. 3 is a partial structural explosion diagram of a driving device and a mounting assembly according to an embodiment of the present application.

Referring to FIG. 1 and FIG. 3, the mounting assembly 21 includes a scale ring 211 and a mounting base 212, the mounting base 212 is arranged on the outer wall of the scale ring 211. The scale ring 211 and the mounting base 212 are both provided with a through hole 213 for the driving end of the driving device 1 to pass through. In the embodiment of the present application, a side of the mounting base 212 facing the scale ring 211 is provided with an arc surface 2121, and the arc surface 2121 abuts to the outer wall of the scale ring 211. The mounting base 212 is fixed with the scale ring 211 by bolt, so that the connection between the scale ring 211 and the mounting base 212 is more stable.

In the embodiment of the present application, the driving device 1 is a portable electric grinder with handle, and an anti-slip pattern is provided on the surface thereof. The driving device 1 can also be a grinding machine such as straight grinding machine or pneumatic grinding machine. There is a driving motor inside the driving device 1, and the working state of the driving motor can be controlled by sliding the switch button. The inner wall of the through hole 213 of the mounting base 212 is provided with an internal thread. The driving end of the driving device 1 penetrates out an end of the handle. The driving device 1 is provided with an external thread at a side thereof close to the driving end, so that the driving device 1 is threadedly connected to the mounting base 212, which realizes the detachable connection between the mounting base 212 and the driving device 1. In particular, during mounting, the mounting base 212 is fixed to the scale ring 211 by bolt, then the driving end of the driving device 1 is positioned in the grinding chamber 26 through the through holes 213 of the mounting base 212 and the scale ring 211. The mounting seat 212 is threadedly connected to the driving device 1, and finally the grinding plate 23 is mounted on the driving end.

In contrast, the mounting base 212 is not limited to be fixed to the scale ring 211 by blot in other embodiments. The mounting base 212 can be integrally with the scale ring 211, the mounting base 212 can clamp the scale ring 211, the mounting base 212 can be clamped in the scale ring 211, or the mounting base 212 and the scale ring 211 can adopt other fixed connection means. The mounting base 212 and the driving device 1 can also be an integration. When the tungsten electrode needs to be grinded, the grinding device 2 only needs to clamp or be clamped to the driving device 1, so that it is convenient to detach the grinding device 2 from the driving device 1, which facilitates changing grinding devices 2 with different sizes and repairing the grinding machine for tungsten electrode.

Figure 4:
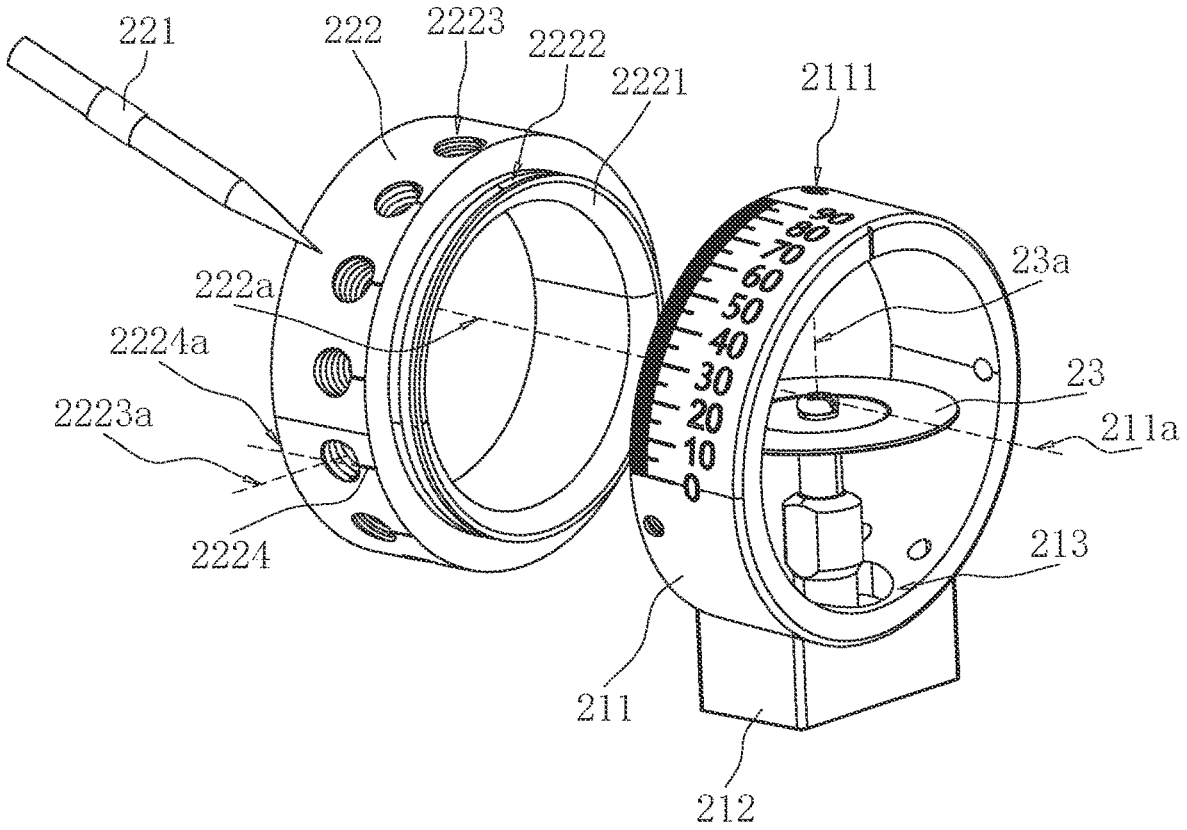
FIG. 4 is a partial structural explosion diagram of a mounting assembly and an adjusting assembly according to an embodiment of the present application.

Referring to FIG. 2 and FIG. 4, the adjusting assembly 22 includes an adjusting ring 222 and a magnifier 24. An annular protrusion 2221 embedded in the scale ring 211 is provided on the end of the adjusting ring 222 facing the scale ring 211. The annular protrusion 2221 is provided with a positioning groove 2222 around the outer wall thereof. Positioning holes 2111 are provided on the outer wall of the scale ring 211 at the positions corresponding to the positioning groove 2222. The scale ring 211 is fixed with the adjusting ring 222 at the positioning holes 2111 and the positioning groove 2222 by positioning components 4. In particular, in this embodiment, there are three positioning holes 2111, and three positioning holes 2111 are distributed in a triangle shape. The positioning component 4 is a set screw. The set screw is inserted in the positioning groove 2222, so that the adjusting ring 222 is hard to separate from the scale ring 211. In addition, by setting the embedding degree of the set screw, the switch between the rotating state and the fixing state of the adjusting ring 222 are realized, which facilitates adjusting the grinding angle of the tungsten electrode and improving the stability of the adjusting ring 222 during grinding, so as to improve the using performance of the tungsten electrode. In actual use, it is only required to adjust the tightness state of two of the set screws to a loose state, and control the tightness state of another set screw to switch the state of the adjusting ring 222.

The scale ring 211 is marked with scale lines. The scale lines of the scale ring 211 are positioned on a side of the scale ring 211 away from the driving device 1. A zero-degree scale line is positioned on the plane of the grinding plate 23, and a ninety-degree scale line is perpendicular to the axial line 23*a* of the grinding plate 23. The diameter and the axial line 211*a* of the scale ring 211 are both positioned on the plane of the grinding plate 23, so that the grinding plate 23 is positioned in the center of the scale ring 211, and the adjusting assembly 22 can adjust the grinding angle of the tungsten electrode more accurately.

Figure 5:
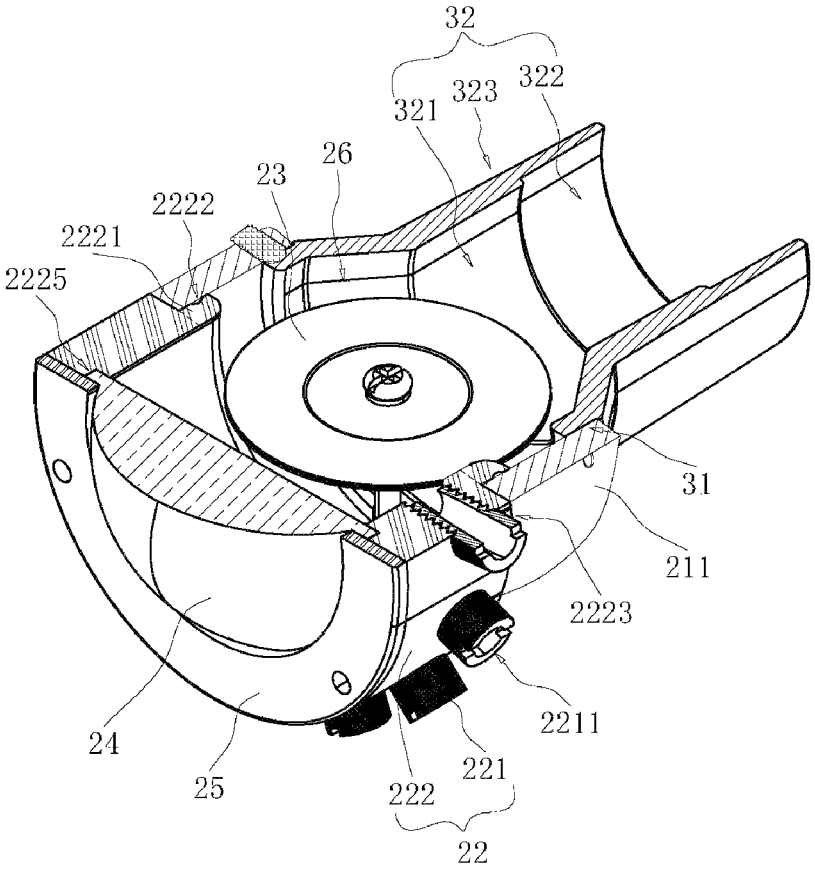
FIG. 5 is a section diagram of a grinding machine according to an embodiment of the present application.

Referring to FIG. 2 and FIG. 5, one or more mounting holes 2223 are provided on the outer wall of the adjusting ring 222. The axial line 2223*a* of the mounting hole 2223 perpendicularly intersects the axial line 211*a* of the scale ring 211, so that during grinding the length direction of the tungsten electrode is perpendicular to the axial line 211*a* of the scale ring 211, so as to ensure the trace line generated on the tungsten electrode is longitudinal, which ensures the consistent grinding angle of the sharp end of the tungsten electrode, and improves the using performance of the tungsten electrode. The clamping component 221 is mounted in the mounting hole 2223. The clamping component 221 includes a clamping hole 2211 for the tungsten electrode to pass through. After the tungsten electrode is inserted, the tungsten electrode can be rotated by hand or tool, so as to adjust the grinding state of the tungsten electrode. An opening of the adjusting ring 222 close to the mounting hole 2223 is provided with a positioning line 2224. The length direction of the positioning line 2224 is parallel to the length direction of the scale line on the scale ring 211, and an extension line 2224*a* of the positioning line 2224 intersects the axis line of the mounting hole 2223. The positioning line 2224 is aligned with the scale line, which facilitates observing the grinding angle of the tungsten electrode, and is convenient to operate.

In particular, the clamping components 221 with different inner diameters can be replaced according to the demand. In this embodiment, there are seven mounting holes 2223 and the clamping component 221 is a copper screw. The tungsten electrode can pass through the copper screw with the similar diameter thereof. The copper screws with different diameters are mounted in the mounting holes 2223, so as to hold the tungsten electrodes with different diameters, which realizes grinding for tungsten electrodes with different sizes. In this application, the clamping component 221 is not limited to be the copper screw, it also can choose other clamping tools with adjustable diameter, in which the inner diameter can be fixed or adjustable. The scale line is positioned at the edge of the scale ring 211 close to the adjusting ring 222. The positioning line 2224 is positioned at the edge of the adjusting ring 222 close to the scale ring 211. When rotating the adjusting ring 222, it can be directly observed whether the positioning line 2224 is aligned with the corresponding scale line.

Figure 6:
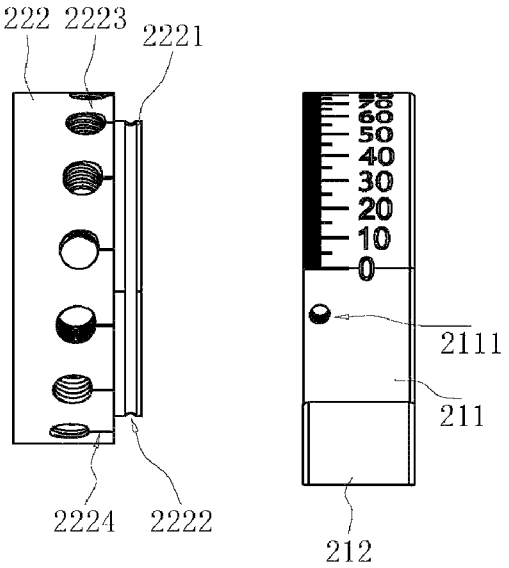
FIG. 6 is a side view diagram of a mounting assembly and an adjusting assembly according to an embodiment of the present application.

Referring to FIG. 5 and FIG. 6, in order to save the limited grinding space and reduce the wear and tear of the grinding plate 23, the mounting holes 2223 are distributed obliquely on the adjusting wheel 222. In the embodiment of the present application, seven mounting holes 2223 are distributed around the adjusting ring 222, are obliquely in a certain angle along the direction away from the scale ring 211 and are distributed in an interval. Mounting the tungsten electrode on the mounting holes 2223 with different oblique states can let the tungsten electrode be grinded at different positions of the grinding plate 23, which reduces the wear and tear of the grinding plate 23 and reduce the replacement cycle of the grinding plate 23, so as to reduce the cost. In addition, when the horizontal distance between the mounting holes 2223 of the adjusting ring 222 according to the demand is large enough, the adjusting ring 222 can grind multiple tungsten electrodes with different grinding angles at the same time. The oblique distribution brings less interaction between the tungsten electrodes during grinding, which improves the grinding efficiency.

Referring to FIG. 2 and FIG. 5, the magnifier 24 is arranged at an opening of the adjusting ring 222 away from the scale ring 211. An annular groove 2225 is provided on the end of the adjusting ring 222 away from the scale ring 211, and the magnifier 24 can be embedded in the annular groove 2225. A sealing ring 25 is provided at the side of the adjusting ring 222 away from the scale ring 211. When the magnifier 24 is embedded in the annular groove 2225, the sealing ring 25 covers the end surface of the adjusting ring 222, so that the magnifier 24 is fixed in the annular groove 2225 and it has a sealing function. The magnifier 23 is arranged close to the side of grinding the tungsten electrode, through which the grinding state of the tungsten electrode can be clearly observed, which facilitates accurately adjusting the grinding angel and coaxiality of the tungsten electrode, which makes the sharp end of the tungsten electrode not easy to be eccentric, so as to improve the using performance of the tungsten electrode.

In order to clearly observe the grinding state of the tungsten electrode, the center of the magnifier 24 is positioned on the plane of the grinding plate 23 and the axial line 211*a* of the scale ring 211 goes through the center point of the magnifier 23 and the center point of the grinding plate 23, that is, the center of the magnifier 24 is aligned with the center of the grinding plate 23, so that the grinding state can be observed during the grinding, which does not need to be too close or stop grinding, which facilitates accurately adjusting the tungsten electrode in the grinding.

Figure 7:
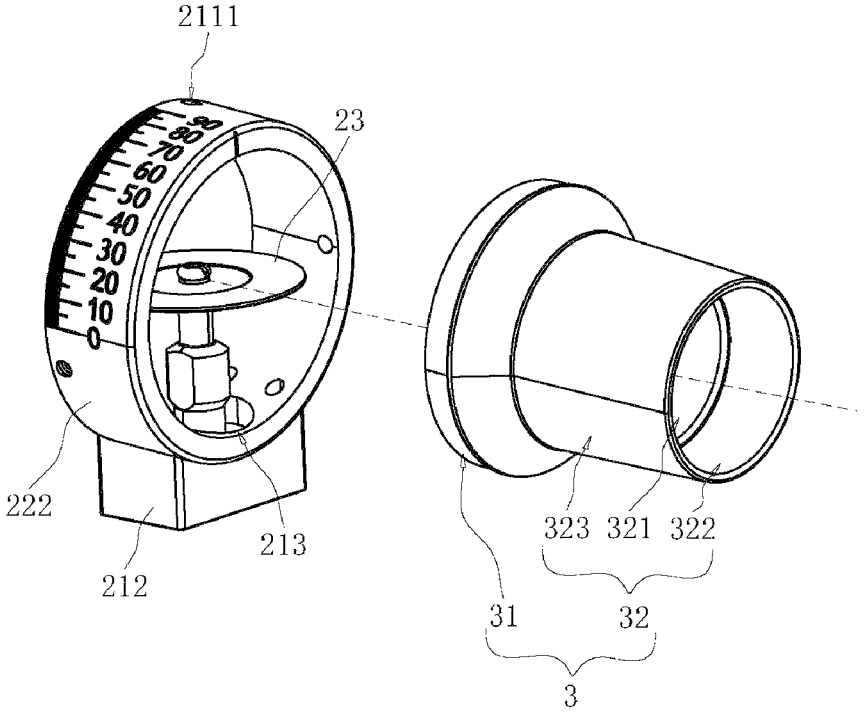
FIG. 7 is an explosion diagram of a mounting assembly and a part of a dust sucking pipe according to an embodiment of the present application.

Referring to FIG. 5 and FIG. 7, a dust sucking pipe 3 is provided at the opening of the scale ring 211 away from the adjusting ring 222, and the dust sucking pipe 3 is used for communicating with an external dust sucking equipment. The sealing ring 25 seals the side of the magnifier 23, so that the harmful dust is not easy to spread out of the grinding chamber 26 during grinding. The dust sucking pipe 3 is communicated with the external dust sucking equipment, which can suck the harmful dust out of the grinding chamber 26, so that the dust won't influence the observation of the grinding state by using magnifier 24, which can prevent the spread of harmful dust from being inhaled by the human body and affecting health.

A mounting portion 31 and a matching portion 32 are provided on two ends of the dust sucking pipe 3 respectively, and the mounting portion 31 is detachably connected to the scale ring 211. In particular, the mounting portion 31 is embedded in the scale ring 211, and is fixed by set screw. In this embodiment, a thread hole is provided on the scale ring 211, and a fixing groove corresponding thereto is provided on the mounting portion 31, so that the fixture is realized by one screw.

The matching portion 32 includes a first matching area 321, a second matching area 322 and a third matching area 323. An annular flange is provided on the inner wall of the matching portion, 32. The inner diameter of the annular flange gradually increases along the direction away from the mounting portion 31 to form the first matching area 321, the first matching area 321 is used to communicate with the dust sucking equipment with a diameter of 32 millimeters. The inner diameter of a side of the matching portion 32 gradually increases along the direction away from the mounting portion 31 to form the second matching area 322, and the second matching area is used to communicate with the dust sucking equipment with a diameter of 35 millimeters. The outer diameter of the matching portion 32 gradually decreases along the direction away from the mounting portion 31 to form the third matching area 323, and the third matching area 323 is used to communicate with other dust sucking equipment with larger diameters. At present, the household dust sucking equipment usually adopts the diameter of 32 millimeters, and the commercial dust sucking equipment usually adopts the diameter of 35 millimeters. In the present application, it can be communicated with dust sucking equipment with different diameters according to the demand, so that the grinding machine for tungsten electrode is suitable for dust sucking equipment with different diameters, so as to increase the application range of the grinding machine for tungsten electrode.

The implement principle of the grinding machine for tungsten electrode in the embodiment of the present application is that: the adjusting ring 222 is firstly rotated according to the demand, and the positioning line 222 is aligned with the corresponding scale line of the scale ring 211. After the alignment, the adjusting ring 222 is fixed to the scale ring 221. The driving device 1 is started, and the driving device 1 drives the grinding plate 23 in the grinding chamber 26 to rotate. The tungsten electrode is put through the clamping component 221, so that the sharp end of the tungsten electrode abuts to the grinding plate 23 and the grinding starts. During the grinding, the tungsten electrode can be rotated by hand or tool to adjust the grinding state. The adjusting ring 222 can be rotated in 360 degrees, so that the grinding angle of the tungsten electrode can be adjusted from null to ninety degrees, which realizes an accurate control of the grinding angle of the tungsten electrode. The grinding angle of the tungsten electrode is consistent, so as to improve the using performance of the tungsten electrode, and improves the welding quality.

The mounting holes 2223 distributed at an interval around the adjusting ring 222 and tiled in a certain angle make the sharp end of the tungsten electrode abut to different positions of the grinding plate 23. The axial line 2223*a* of the mounting hole 2223 perpendicularly intersects the axial line 211*a* of the scale ring 211, and the axial line 211*a* of the scale ring 211 is coincided with the diameter of the grinding plate 23, so that the trace line generated by grinding the sharp end surface of the tungsten electrode is consistent with the axial line of the tungsten electrode, which is same as the current direction, so as to improve the stability of the arc.

The grinding state of the tungsten electrode is observed by using the magnifier 23, the grinding angle and coaxiality of the tungsten electrode can be accurately adjusted in time, so that the sharp end is not easy to be eccentric, further to improve the using performance of the tungsten electrode and improve the welding quality. It can be matched with dust sucking equipment with different diameters by the dust sucking pipe 3. The harmful dust can be sucked out of the grinding chamber 26, so as to prevent the spread of harmful dust from being inhaled by the human body and affecting health, which increases the application range of the grinding machine for tungsten electrode.

The above are the preferred embodiments of the present application, which are not intended to limit the protection scope of the present application. Therefore, all equivalent changes made according to the structure, shape and principle of the present application should be covered within the protection scope of the present application.

What is claimed is:

1. A grinding machine for tungsten electrodes, comprising a driving device and a grinding device arranged on a driving end of the driving device; wherein the grinding device comprises:

a mounting assembly comprising a scale ring and a mounting base arranged on an outer wall of the scale ring, and an adjusting assembly comprising an adjusting ring;

wherein the mounting assembly is mounted on the driving device, the driving end of the driving device passes through the mounting assembly, the mounting assembly is provided with a grinding chamber, a grinding plate is provided at the driving end of the driving device, the grinding plate is positioned in the grinding chamber, the scale ring and the mounting base are both provided with a through hole for the driving end of the driving device to pass through, and the mounting base is detachably connected to the driving device;

the adjusting assembly is rotatably connected to the mounting assembly, the adjusting assembly is provided with a clamping component, the adjusting assembly is configured to rotate to adjust a grinding angle with which a tungsten electrode is grinded by the grinding plate, the adjusting ring is rotatably connected to the scale ring, an annular protrusion is formed on an end face of the adjusting ring facing the scale ring, the annular protrusion is configured to be embedded in the scale ring, a positioning groove is provided on the annular protrusion around an outer wall of the annular protrusion, positioning holes are provided on the outer wall of the scale ring at positions corresponding to the positioning groove, and the scale ring is fixed with the adjusting ring at the positioning holes and the positioning groove by positioning components;

a plurality of mounting holes are provided on an outer wall of the adjusting ring, the clamping component is mounted in the plurality of mounting holes, a positioning line is scribed on the outer wall of the adjusting ring close to each of the plurality of mounting holes, a length direction of the positioning line is parallel to a length direction of a scale line on the scale ring, and an extension line of the positioning line intersects a center axial line of the plurality of mounting holes;

the center axial line of the plurality of mounting holes perpendicularly intersects a center axial line of the adjusting ring, and the plurality of mounting holes are distributed at an interval on the adjusting ring and are tilted along an axial direction of the adjusting ring.

2. The grinding machine for tungsten electrodes according to claim 1, wherein a plane where the grinding plate is located coincides with a center axial line of the scale ring, scale lines on the scale ring are positioned at a side of the scale ring away from the driving device, a zero-degree scale line is positioned on the plane where the grinding plate is located, and a ninety-degree scale line is perpendicular to a center axial line of the grinding plate.

3. The grinding machine for tungsten electrodes according to claim 1, wherein the clamping component has a clamping hole for the tungsten electrode to pass through, the grinding chamber is in communication with an external space through the clamping hole, and an inner diameter of the clamping hole is adjustable.

4. The grinding machine for tungsten electrodes according to claim 3, wherein the adjusting assembly further comprises a magnifier, and the magnifier is arranged at an opening of the adjusting ring away from the scale ring.

5. The grinding machine for tungsten electrodes according to claim 4, wherein the adjusting ring is provided with a sealing ring at a side of the adjusting ring where the magnifier is located, a dust sucking pipe is provided at an opening of the scale ring away from the adjusting ring, and the dust sucking pipe is used for communicating with an external dust sucking equipment.

6. The grinding machine for tungsten electrodes according to claim 5, wherein a mounting portion and a matching portion are provided on two ends of the dust sucking pipe respectively, the mounting portion is detachably connected to the scale ring, an annular flange is provided on an inner wall of the matching portion, an inner diameter of the annular flange gradually increases along a direction away from the mounting portion to form a first matching area, an inner diameter of the matching portion gradually increases along the direction away from the mounting portion to form a second matching area, and an outer diameter of the matching portion gradually decreases along the direction away from the mounting portion to form a third matching area.

* * * * *